US010865641B1

(12) United States Patent
Yin et al.

(10) Patent No.: US 10,865,641 B1
(45) Date of Patent: Dec. 15, 2020

(54) ASYMMETRIC COORDINATED SUPPORT DEVICE FOR GOB SIDE ENTRY BASED ON COMBINATION OF FLEXIBILITY AND RIGIDITY

(71) Applicant: North China Institute of Science and Technology, Langfang (CN)

(72) Inventors: Shuaifeng Yin, Langfang (CN); Zhiheng Cheng, Langfang (CN)

( * ) Notice: Subject to any disclaimer, the term of this patent is extended or adjusted under 35 U.S.C. 154(b) by 0 days.

(21) Appl. No.: 16/601,546

(22) Filed: Oct. 14, 2019

(30) Foreign Application Priority Data

Sep. 11, 2019 (CN) ..... 2019 1 0861394

(51) Int. Cl.
*E21D 11/00* (2006.01)
*E21D 21/00* (2006.01)
*E21D 20/00* (2006.01)

(52) U.S. Cl.
CPC ..... *E21D 21/006* (2016.01); *E21D 21/008* (2013.01); *E21D 20/00* (2013.01)

(58) Field of Classification Search
CPC ..... E21D 11/006; E21D 11/00; E21D 11/15; E21D 11/003
USPC ..... 405/150.1
See application file for complete search history.

(56) References Cited

FOREIGN PATENT DOCUMENTS

| | | | |
|---|---|---|---|
| GB | 2185774 | * | 7/1987 |
| JP | 01154997 | * | 6/1989 |

* cited by examiner

*Primary Examiner* — Sean D Andrish
(74) *Attorney, Agent, or Firm* — W&K IP

(57) ABSTRACT

An asymmetric coordinated support device for gob side entry is provided. The device includes an inner support board, an outer roadway side support assembly, an outer roof support assembly, and a flexible reinforcement layer, wherein the inner support board is supported to an innermost side closest to a rock layer to be supported in an extending direction of the roadway, and wherein a side of the inner support board remote from the rock layer is provided with the outer roadway side support assembly extending along the roadway direction and the outer roof support assembly located on a roof of the outer roadway side support assembly.

9 Claims, 4 Drawing Sheets

ASYMMETRIC COORDINATED SUPPORT DEVICE FOR GOB SIDE ENTRY BASED ON COMBINATION OF FLEXIBILITY AND RIGIDITY

CROSS-REFERENCE TO RELATED APPLICATIONS

This application claims priority to Chinese Patent Application No. 201910861394.2 with a filing date of Sep. 11, 2019. The content of the aforementioned application, including any intervening amendments thereto, are incorporated herein by reference.

TECHNICAL FIELD

The present invention relates to the technical field of asymmetric coordinated support device for gob side entry, in particular, to an asymmetric coordinated support device for gob side entry based on combination of flexibility and rigidity.

BACKGROUND

During the mining process of the coal layer, the basic purpose for supporting the roadway is to alleviate and reduce the movement of the surrounding rock layers, so that the roadway section will not be excessively reduced, and the surrounding rock layers that have been scattered and destroyed will be prevented from falling. Currently-used method for supporting the entry is to utilize an anchor bolt or an anchor cable to support the entry with combination of a support roof board. This supporting method requires the anchor bolt or the anchor cable and the support roof board to form a unitary with the roadway side board, so as to provide a support force for the falling the rock wall or the entry wall. For a hard or strong rock wall, with this method, the support effect is better and the support ability can be effectively guaranteed, but for some soft gob side entry, a slip may occur due to the softness between the rock layers. This slip may cause the support board to withstand a heavy and uneven force, which will aggravate the concentration of the support board, causing deformation or breakage of the support board, and problems such as collapse. This is mainly caused by the adoption of a rigid connection by the support board and the anchor bolt, disability to correct the force according to the deposition of the rock layers by its own, and ensuring the uniformity of the force to reduce the concentration of the force.

Therefore, the present invention provides an asymmetric coordinated support device for gob side entry based on combination of flexibility and rigidity to solve the above problems in the background.

SUMMARY

The purpose of the present invention is to provide an asymmetric coordinated support device for gob side entry based on combination of flexibility and rigidity to solve the above problems in the background.

To this end, the present invention provides the following technical solutions:

An asymmetric coordinated support device for gob side entry based on combination of flexibility and rigidity, comprising an inner support board, an outer roadway side support assembly, an outer roof support assembly and a flexible reinforcement layer, wherein the inner support board is supported to an innermost side closest to a rock layer to be supported in an extending direction of the roadway; a side of the inner support board remote from the rock layer is provided with the outer roadway side support assembly extending along the roadway direction and the outer roof support assembly located on a roof of the outer roadway side support assembly; characterized in that, the flexible reinforcement layer is provided between the outer roadway side support assembly and the inner support board, and the outer roof support assembly and the inner support board;

the flexible reinforcement layer includes a plurality of sets of flexible micro-slip assemblies and solidified reinforcement layers, wherein the flexible micro-slip assembly is disposed between the outer roadway side support assembly and the inner support board or between the outer roof support assembly and the inner support board in an inclined manner with a certain inclination angle to a horizontal direction;

and two sets of flexible micro-slip assemblies that are up and down or horizontally adjacent are inclined in opposite directions;

the solidification reinforcement layer is filled in a flexible reinforcement cavity configured by the flexible micro-slip assembly, the outer roadway side support assembly, the outer top support assembly and the inner support board;

the flexible micro-slip assembly is capable of micro-slip along its inclined extension direction, and in the case of micro-slip, a horizontal component and a vertical component of the slipping force act on the outer roadway side support assembly, the outer roof support assembly or the inner support board.

Further, preferably, the flexible micro-slip assembly includes an upper flexible support seat, a lower flexible support seat and a vertical component seat, wherein the upper flexible support seat extends in an inclined direction and is disposed between the outer roadway side support assembly or the outer roof support assembly and the inner support board; a lower portion of the upper flexible support seat is abutted with the lower flexible support seat provided in the same direction as the extension thereof, and a central portion of the lower flexible support seat is provided with a through hole; a roof of the vertical component seat is integrally fixedly connected below the upper flexible support seat, and the vertical component seat is disposed downward through the through hole.

Further, preferably, a lower end of the vertical component seat is provided with a plurality of parallel-arranged gaps extending in a vertical direction for facilitating a micro-deformation and micro-slip of the vertical component seat.

Further, preferably, an upper end surface of the upper flexible support seat is welded or integrally provided with a plurality of reinforcing ribs extending upward and spaced apart, and a lower end surface of the lower flexible support seat is also welded or integrally provided with a plurality of reinforcing ribs extending upward and spaced apart.

Further, preferably, the flexible micro-slip assembly is made of spring steel material, and the solidified reinforcement layer is concrete or a quick setting agent.

Further, preferably, the flexible micro-slip assembly has an angle of inclination of the extending direction from the horizontal direction of 15 to 60 degrees.

Further, preferably, the inner support board is anchored to the rock layer to be supported by an anchor bolt and/or an anchor cable extending into the rock layer, and the outer roadway side support assembly, the outer roof support assembly and the flexible reinforcement layer are also anchored integrally to the rock layer to be supported by an anchor bolt and/or an anchor cable extending into the rock layer.

Further, preferably, an inner surface of the inner support board is fixedly mounted with a first backing board, and an outer surface of the first backing board is fixedly mounted with the anchor bolt or the anchor cable, an inner portion of the flexible reinforcement layer being opened with a movable groove; the outer roadway side support assembly includes a second backing board, a first support spring, a side support board, a first block, a first connecting block, and an anchor bolt or an anchor cable; a side of the side support board is fixedly mounted with the first support spring, and an inner portion of the side support board is fixedly mounted with the second backing board; a side of the second backing board is fixedly connected with the anchor bolt or the anchor cable, a side of the side support board is fixedly mounted with the first connecting block at an upper end and a lower end of the first support spring, and a side of the first connecting block is fixedly mounted with the block.

Further, preferably, the outer roof support assembly includes an anchor bolt or an anchor cable, a third backing sheet, a second connecting block, a horizontal support board, a second support spring and a second block; an upper surface of the horizontal support board is fixedly mounted with the second support spring, and an inner portion of the horizontal support board is fixedly mounted with the third backing sheet; the upper surface of the horizontal support board is fixedly mounted with the second connecting block at two sides of the second support spring, an upper surface of the third backing sheet is fixedly mounted with the anchor bolt or the anchor cable, and an upper surface of the second connecting block is fixedly mounted with the second block.

Further, preferably, the anchor bolt or the anchor cable is fixed with the first backing board by a nut, and an inner portion of the first backing board is fixedly mounted with a sealing plug; the other side of the first support spring is connected with the flexible reinforcement layer, and the first connecting block is mounted in the movable groove; an upper end of the second support spring is connected with the flexible reinforcement layer, and the second block is mounted in the movable groove.

Compared with the prior art, the present invention has the following beneficial effects:

In the present invention, by disposing a flexible reinforcement layer between the outer roadway side support assembly, the outer roof support assembly and the inner support board, the uniformity of the force on an outer roadway side support assembly and an outer roof support assembly during the support may be effectively improved, and a flexible reinforcement layer can be adjusted automatically even if the rock layer has a certain slip, so that the support force on the outer roadway side support assembly and the outer roof support assembly can be adjusted automatically, thereby preventing the support force from appearing too concentrated in a certain region and ensuring the support ability. At the same time, in the present invention, the flexible reinforcement layer includes a plurality of sets of flexible micro-slip assemblies and solidified reinforcement layers, wherein the flexible micro-slip assembly is disposed between the outer roadway side support assembly and the inner support board or between the outer roof support assembly and the inner support board in a manner inclined at a certain oblique angle with respect to the horizontal direction, so that a slight slip in a certain space can be achieved to improve the adaptive and self-adjusting ability. In addition, two sets of flexible micro-slip assemblies of the upper and lower sides in the present invention are inclined in opposite directions, which improves the uniformity of the force and the uniform distribution of the inner and outer support forces during the slip, thereby improving the ability of the support adjustment and ensuring the support reliability of the support board.

DETAILED DESCRIPTION

Figure 1:
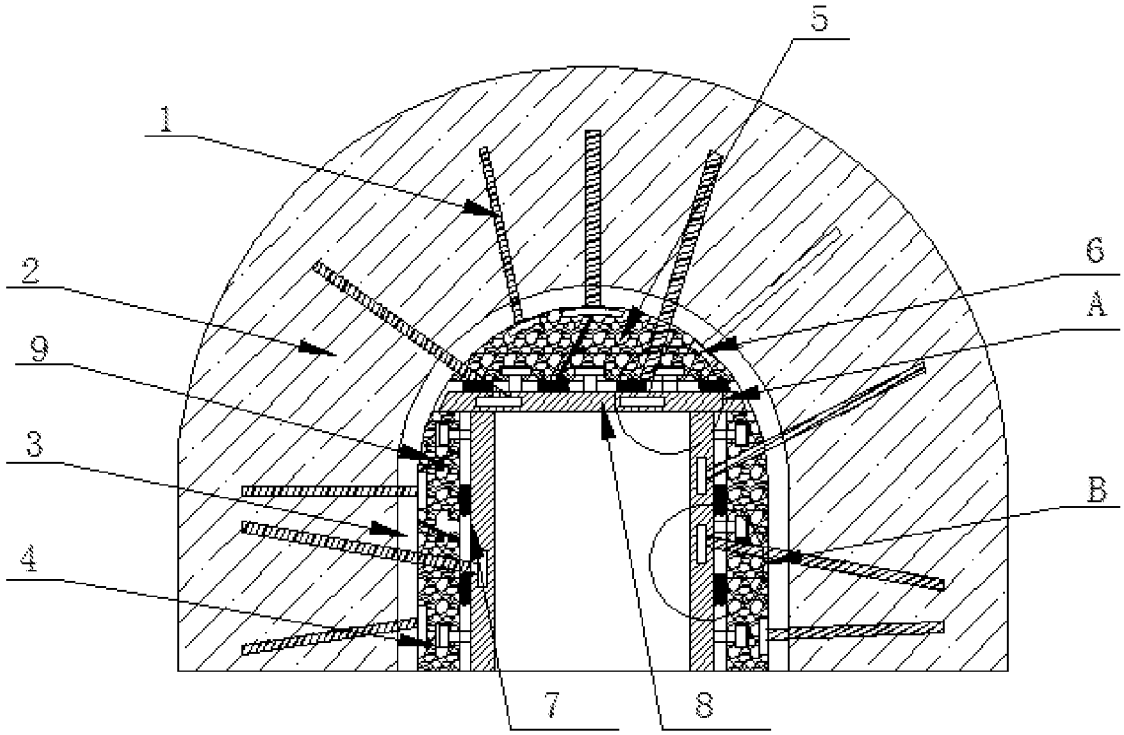
FIG. 1 is a structural view of an asymmetric coordinated support device for gob side entry based on combination of flexibility and rigidity.
Figure 2:
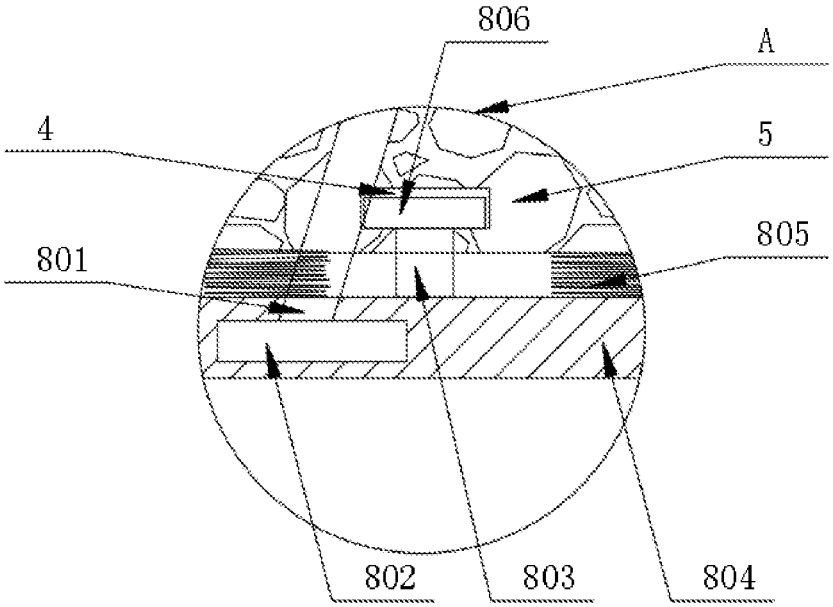
FIG. 2 is an enlarged view of A in FIG. 1.
Figure 3:
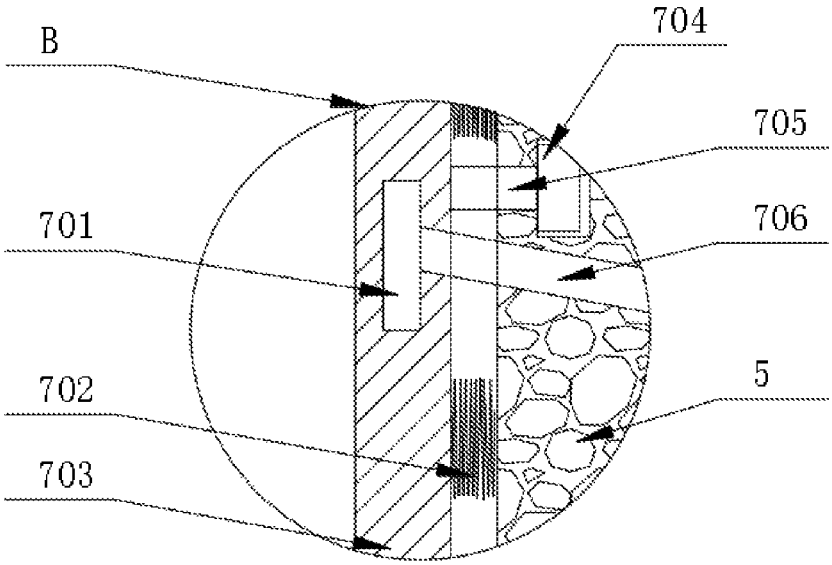
FIG. 3 is an enlarged view of B in FIG. 1.
Figure 4:
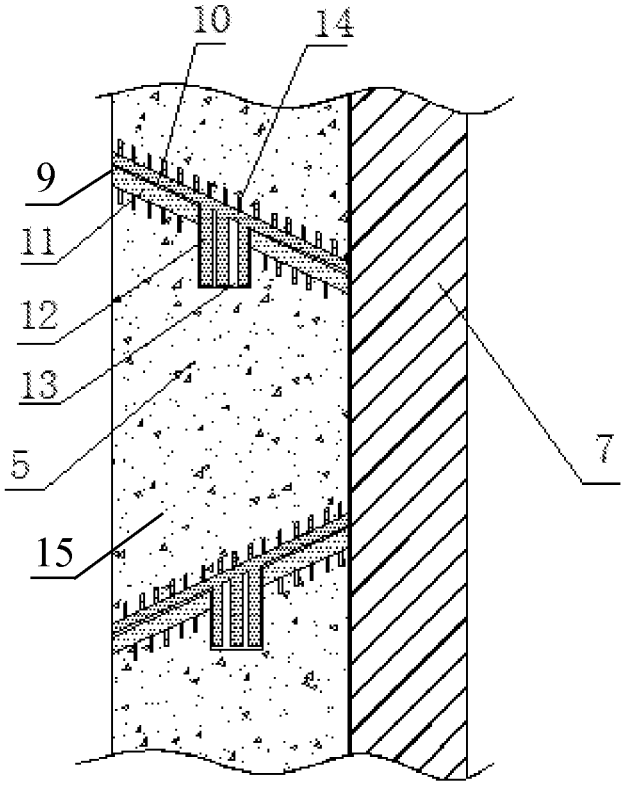
FIG. 4 is a structural view of an arrangement of a flexible micro-slip assembly of a flexible reinforcement layer and a solidified reinforcement layer of an asymmetric coordinated support device for gob side entry based on combination of flexibility and rigidity.

With reference to FIGS. 1 to 4, in an embodiment of the present invention, an asymmetric coordinated support device for gob side entry based on combination of flexibility and rigidity, comprising an inner support board 3, an outer roadway side support assembly 7, an outer roof support assembly 8 and a flexible reinforcement layer 5, wherein the inner support board is supported to an innermost side closest to a rock layer to be supported 2 in an extending direction of the roadway; a side of the inner support board remote from the rock layer is provided with the outer roadway side support assembly 7 extending along the roadway direction and the outer roof support assembly 8 located on a roof of the outer roadway side support assembly; characterized in that, the flexible reinforcement layer 5 is provided between the outer roadway side support assembly 7 and the inner support board 3, and the outer roof support assembly 8 and the inner support board 3; the flexible reinforcement layer 5 includes a plurality of sets of flexible micro-slip assemblies 9 and solidified reinforcement layers 15, wherein the flexible micro-slip assembly 9 is disposed between the outer roadway side support assembly 7 and the inner support board 3 or between the outer roof support assembly 8 and the inner support board 3 in an inclined manner with a certain inclination angle to a horizontal direction; and two sets of flexible micro-slip assemblies 9 that are up and down or horizontally adjacent are inclined in opposite directions;

the solidification reinforcement layer 15 is filled in a flexible reinforcement cavity configured by the flexible micro-slip assembly 9, the outer roadway side support assembly 7, the outer top support assembly 8 and the inner support board 3; the flexible micro-slip assembly 9 is capable of micro-slip along its inclined extension direction, and in the case of micro-slip, a horizontal component and a vertical component of the slipping force act on the outer roadway side support assembly 7, the outer roof support assembly 8 or the inner support board 3.

In the present embodiment, the flexible micro-slip assembly 9 includes an upper flexible support seat 10, a lower flexible support seat 11 and a vertical component seat 12, wherein the upper flexible support seat 10 extends in an inclined direction and is disposed between the outer roadway side support assembly 7 or the outer roof support assembly 8 and the inner support board 3; a lower portion of the upper flexible support seat is abutted with the lower flexible support seat 11 provided in the same direction as the extension thereof, and a central portion of the lower flexible support seat is provided with a through hole; a roof of the vertical component seat is integrally fixedly connected below the upper flexible support seat, and the vertical component seat 12 is disposed downward through the through hole.

As a preferred embodiment, a lower end of the vertical component seat 12 is provided with a plurality of parallel-arranged gaps 13 extending in a vertical direction for facilitating a micro-deformation and micro-slip of the vertical component seat 12.

Among them, an upper end surface of the upper flexible support seat is welded or integrally provided with a plurality of reinforcing ribs 14 extending upward and spaced apart, and a lower end surface of the lower flexible support seat is also welded or integrally provided with a plurality of reinforcing ribs 14 extending upward and spaced apart.

In the present invention, the flexible micro-slip assembly is made of spring steel material, and the solidified reinforcement layer is concrete or a quick setting agent. The flexible micro-slip assembly has an angle of inclination of the extending direction from the horizontal direction of 15 to 60 degrees.

Among them, the inner support board 3 is anchored to the rock layer to be supported by an anchor bolt and/or an anchor cable 1 extending into the rock layer, and the outer roadway side support assembly 7, the outer roof support assembly 8 and the flexible reinforcement layer 5 are also anchored integrally to the rock layer to be supported by an anchor bolt and/or an anchor cable 1 extending into the rock layer.

An inner surface of the inner support board 3 is fixedly mounted with a first backing board 6, and an outer surface of the first backing board 6 is fixedly mounted with the anchor bolt or the anchor cable 1, an inner portion of the flexible reinforcement layer 5 being opened with a movable groove 4; the outer roadway side support assembly 7 includes a second backing board 701, a first support spring 702, a side support board 703, a first block 704, a first connecting block 705, and an anchor bolt or an anchor cable 706; a side of the side support board 703 is fixedly mounted with the first support spring 702, and an inner portion of the side support board 703 is fixedly mounted with the second backing board 701; a side of the second backing board 701 is fixedly connected with the anchor bolt or the anchor cable 706, a side of the side support board 703 is fixedly mounted with the first connecting block 705 at an upper end and a lower end of the first support spring 702, and a side of the first connecting block 705 is fixedly mounted with the block 704.

The outer roof support assembly 8 includes an anchor bolt or an anchor cable 801, a third backing sheet 802, a second connecting block 803, a horizontal support board 804, a second support spring 805 and a second block 806; an upper surface of the horizontal support board 804 is fixedly mounted with the second support spring 805, and an inner portion of the horizontal support board 804 is fixedly mounted with the third backing sheet 802; the upper surface of the horizontal support board 804 is fixedly mounted with the second connecting block 803 at two sides of the second support spring 805, an upper surface of the third backing sheet (802) is fixedly mounted with the anchor bolt or the anchor cable 801, and an upper surface of the second connecting block 803 is fixedly mounted with the second block 806.

The anchor bolt or the anchor cable 1 is fixed with the first backing board 6 by a nut, and an inner portion of the first backing board 6 is fixedly mounted with a sealing plug; the other side of the first support spring 702 is connected with the flexible reinforcement layer 5, and the first connecting block 705 is mounted in the movable groove 4; an upper end of the second support spring 805 is connected with the flexible reinforcement layer 5, and the second block 806 is mounted in the movable groove 4.

In the present invention, by disposing a flexible reinforcement layer between the outer roadway side support assembly, the outer roof support assembly and the inner support board, the uniformity of the force on an outer roadway side support assembly and an outer roof support assembly during the support may be effectively improved, and a flexible reinforcement layer can be adjusted automatically even if the rock layer has a certain slip, so that the support force on the outer roadway side support assembly and the outer roof support assembly can be adjusted automatically, thereby preventing the support force from appearing too concentrated in a certain region and ensuring the support ability. At the same time, in the present invention, the flexible reinforcement layer includes a plurality of sets of flexible micro-slip assemblies and solidified reinforcement layers, wherein the flexible micro-slip assembly is disposed between the outer roadway side support assembly and the inner support board or between the outer roof support assembly and the inner support board in a manner inclined at a certain oblique angle with respect to the horizontal direction, so that a slight slip in a certain space can be achieved to improve the adaptive and self-adjusting ability. In addition, two sets of flexible micro-slip assemblies of the upper and lower sides in the present invention are inclined in opposite directions, which improves the uniformity of the force and the uniform distribution of the inner and outer support forces during the slip, thereby improving the ability of the support adjustment and ensuring the support reliability of the support board.

What is mentioned above is only the specific implementation of the present invention, but does not limit the protection scope of the present invention. All the equivalents or modifications made by anyone skilled in the art in accordance with the technical solutions of the present invention and the inventive concept thereof within the technical scope of the present disclosure are intended to be included within the scope of the present invention.

We claim:

1. An asymmetric coordinated support device for gob side entry based on combination of flexibility and rigidity, comprising an inner support board (3), an outer roadway side support assembly (7), an outer roof support assembly (8) and a flexible reinforcement layer (5), wherein the inner support board (3) is supported to an innermost side closest to a rock layer to be supported (2) in an extending direction of a roadway; a side of the inner support board remote from the rock layer is provided with the outer roadway side support assembly (7) extending along the direction of the roadway and the outer roof support assembly (8) located on a roof of the outer roadway side support assembly; characterized in that, the flexible reinforcement layer (5) is provided between the outer roadway side support assembly (7) and the inner support board (3), and the outer roof support assembly (8) and the inner support board (3);

the flexible reinforcement layer (5) includes a plurality of sets of flexible micro-slip assemblies (9) and solidified reinforcement layers (15), wherein each flexible micro-slip assembly (9) is disposed between the outer roadway side support assembly (7) and the inner support board (3) or between the outer roof support assembly (8) and the inner support board (3) in an inclined manner with a certain inclination angle to a horizontal direction;

each flexible micro-slip assembly (9) is inclined in a direction and has an inclined extension direction;

two sets of flexible micro-slip assemblies (9) that are up and down or horizontally adjacent are inclined in opposite directions;

each solidification reinforcement layer (15) is filled in a flexible reinforcement cavity configured by the flexible micro-slip assembly (9), the outer roadway side support assembly (7), the outer top support assembly (8) and the inner support board (3);

each flexible micro-slip assembly (9) is capable of micro-slip along its inclined extension direction, and in the case of micro-slip, a horizontal slipping force and a vertical slipping force act on the outer roadway side support assembly (7), the outer roof support assembly (8) or the inner support board (3); and each flexible micro-slip assembly (9) includes an upper flexible support seat (10), a lower flexible support seat (11) and a vertical component seat (12), wherein the upper flexible support seat (10) extends in an inclined direction and is disposed between the outer roadway side support assembly (7) or the outer roof support assembly (8) and the inner support board (3); a lower portion of the upper flexible support seat is abutted with the lower flexible support seat (11) provided in the same direction as the extension thereof, and a central portion of the lower flexible support seat is provided with a through hole; a roof of the vertical component seat is integrally fixedly connected below the upper flexible support seat, and the vertical component seat (12) is disposed downward through the through hole.

2. The asymmetric coordinated support device for gob side entry based on combination of flexibility and rigidity according to claim 1, characterized in that a lower end of the vertical component seat (12) is provided with a plurality of parallel-arranged gaps (13) extending in a vertical direction for facilitating a micro-deformation and micro-slip of the vertical component seat (12).

3. The asymmetric coordinated support device for gob side entry based on combination of flexibility and rigidity according to claim 1, characterized in that an upper end surface of the upper flexible support seat is welded or integrally provided with a plurality of reinforcing ribs (14) extending upward and spaced apart, and a lower end surface of the lower flexible support seat is also welded or integrally provided with a plurality of reinforcing ribs (14) extending upward and spaced apart.

4. The asymmetric coordinated support device for gob side entry based on combination of flexibility and rigidity according to claim 1, characterized in that each flexible micro-slip assembly is made of spring steel material, and the solidified reinforcement layer is concrete or a quick setting agent.

5. The asymmetric coordinated support device for gob side entry based on combination of flexibility and rigidity according to claim 1, characterized in that each flexible micro-slip assembly (9) has an angle of inclination of the extending direction from the horizontal direction of 15 to 60 degrees.

6. The asymmetric coordinated support device for gob side entry based on combination of flexibility and rigidity according to claim 1, characterized in that the inner support board (3) is anchored to the rock layer to be supported by an anchor bolt or an anchor cable (1) extending into the rock layer, and the outer roadway side support assembly (7), the outer roof support assembly (8) and the flexible reinforcement layer (5) are also anchored integrally to the rock layer to be supported by an anchor bolt and/or an anchor cable (1) extending into the rock layer.

7. The asymmetric coordinated support device for gob side entry based on combination of flexibility and rigidity according to claim 6, characterized in that an inner surface of the inner support board (3) is fixedly mounted with a first backing board (6), and an outer surface of the first backing board (6) is fixedly mounted with the anchor bolt or the anchor cable (1), an inner portion of the flexible reinforcement layer (5) being opened with a movable groove (4); outer roadway side support assembly (7) includes a second backing board (701), a first support spring (702), a side support board (703), a first block (704), a first connecting block (705), and an anchor bolt or an anchor cable (706); a side of the side support board (703) is fixedly mounted with the first support spring (702), and an inner portion of the side support board (703) is fixedly mounted with the second backing board (701); a side of the second backing board (701) is fixedly connected with the anchor bolt or the anchor cable (706), a side of the side support board (703) is fixedly mounted with the first connecting block (705) at an upper end and a lower end of the first support spring (702), and a side of the first connecting block (705) is fixedly mounted with the first block (704).

8. The asymmetric coordinated support device for gob side entry based on combination of flexibility and rigidity according to claim 6, characterized in that the outer roof support assembly (8) includes an anchor bolt or an anchor cable (801), a third backing sheet (802), a second connecting block (803), a horizontal support board (804), a second support spring (805) and a second block (806); an upper surface of the horizontal support board (804) is fixedly mounted with the second support spring (805), and an inner portion of the horizontal support board (804) is fixedly mounted with the third backing sheet (802); the upper surface of the horizontal support board (804) is fixedly mounted with the second connecting block (803) at two sides of the second support spring (805), an upper surface of the third backing sheet (802) is fixedly mounted with the anchor bolt or the anchor cable (801), and an upper surface of the second connecting block (803) is fixedly mounted with the second block (806).

9. The asymmetric coordinated support device for gob side entry based on combination of flexibility and rigidity according to claim 8, characterized in that the anchor bolt or the anchor cable (1) is fixed with the first backing board (6) by a nut, and an inner portion of the first backing board (6) is fixedly mounted with a sealing plug; the other side of the first support spring (702) is connected with the flexible reinforcement layer (5), and the first connecting block (705) is mounted in a movable groove (4); an upper end of the second support spring (805) is connected with the flexible reinforcement layer (5), and the second block (806) is mounted in the movable groove (4).

* * * * *